US007870995B1

(12) United States Patent
Kaltman et al.

(10) Patent No.: US 7,870,995 B1
(45) Date of Patent: Jan. 18, 2011

(54) FOLDABLE PACKAGING CONTAINER

(75) Inventors: Dennis M. Kaltman, Princeton, NJ (US); Richard C. Thibault, Westchester, PA (US); John R. Widener, Haslett, MI (US); Carol J. Moore, Grand Rapids, MI (US)

(73) Assignee: Multi Packaging Solutions, Lansing, MI (US)

( * ) Notice: Subject to any disclaimer, the term of this patent is extended or adjusted under 35 U.S.C. 154(b) by 0 days.

(21) Appl. No.: 12/618,395

(22) Filed: Nov. 13, 2009

Related U.S. Application Data

(63) Continuation of application No. 12/566,766, filed on Sep. 25, 2009.

(51) Int. Cl.
*B65D 5/22* (2006.01)
*B65D 5/42* (2006.01)

(52) U.S. Cl. ..... 229/175; 206/485; 206/485.1; 206/565; 206/784; 229/114; 229/186; 229/931

(58) Field of Classification Search ..... 229/114, 229/175, 176, 186, 931; 206/427, 476, 485, 206/485.1, 562–565, 784
See application file for complete search history.

(56) References Cited

U.S. PATENT DOCUMENTS

| | | | | | |
|---|---|---|---|---|---|
| 329,559 | A | | 11/1885 | Hohenstein | |
| 1,046,017 | A | | 12/1912 | Reber | |
| 1,833,492 | A | * | 11/1931 | Miller | 229/186 |
| 2,151,472 | A | | 3/1939 | Hubbard | |
| 2,189,602 | A | | 2/1940 | Denny | |
| 2,306,624 | A | * | 12/1942 | Harris | 206/485 |
| 2,334,425 | A | | 11/1943 | Lowey | |
| 2,391,767 | A | | 12/1945 | Beerend | |
| 2,536,530 | A | | 1/1951 | Bergstein | |
| 2,621,783 | A | * | 12/1952 | Buttery | 206/562 |
| 2,702,663 | A | * | 2/1955 | Klein | 229/176 |
| 2,942,769 | A | * | 6/1960 | Kuchenbecker | 229/176 |
| 2,944,719 | A | | 7/1960 | Arneson | |
| 3,091,381 | A | * | 5/1963 | Conescu | 229/186 |
| 3,314,194 | A | | 4/1967 | Halleck | |
| 3,338,503 | A | | 8/1967 | Beh | |
| 3,443,681 | A | * | 5/1969 | Wysocki | 206/485.1 |

(Continued)

FOREIGN PATENT DOCUMENTS

DE 7819435 U 10/1978

(Continued)

OTHER PUBLICATIONS

Copending U.S. Appl. No. 12/566,766, filed Sep. 25, 2009.

(Continued)

*Primary Examiner*—Gary E Elkins
(74) *Attorney, Agent, or Firm*—Dobrusin & Thennisch PC

(57) ABSTRACT

A foldable packaging which may include a liquid-resistant paperboard form that is foldable to provide an attractive stackable container that resists water leakage, can be assembled without fastening hardware and has concealed gussets. The packaging can be folded into overlapping flaps and wings which are folded and interlocked to define a generally trapezoidal packaging which can receive a variety of different pot sizes and types. The die cut pattern forming the packaging can be of a universal shape but formed in a variety of different sizes to accommodate different sized potted plants.

19 Claims, 10 Drawing Sheets

U.S. PATENT DOCUMENTS

| | | | | | |
|---|---|---|---|---|---|
| 3,465,948 | A | * | 9/1969 | Boyer | 229/125.19 |
| 3,559,869 | A | * | 2/1971 | Reynolds | 229/114 |
| 3,567,106 | A | | 3/1971 | Anderson | |
| 3,606,078 | A | | 9/1971 | Phillips, Jr. | |
| 3,754,642 | A | | 8/1973 | Stidolph | |
| 3,869,828 | A | | 3/1975 | Matsumoto | |
| 3,913,823 | A | | 10/1975 | Lin | |
| 3,993,240 | A | | 11/1976 | Matsuyama | |
| 4,055,293 | A | * | 10/1977 | Stramaglia | 229/175 |
| 4,119,265 | A | | 10/1978 | Dlugopolski | |
| 4,242,835 | A | | 1/1981 | Mondragon | |
| 4,260,098 | A | * | 4/1981 | Manizza et al. | 229/114 |
| 4,512,511 | A | * | 4/1985 | Zimmermann | 229/175 |
| 5,029,708 | A | | 7/1991 | Alonso et al. | |
| 5,070,645 | A | | 12/1991 | Vaughn | |
| 5,284,294 | A | | 2/1994 | Floyd | |
| D398,261 | S | | 9/1998 | Weder et al. | |
| 6,050,483 | A | | 4/2000 | Haraldsson et al. | |
| 6,345,467 | B1 | | 2/2002 | Weder | |
| 6,421,959 | B1 | | 7/2002 | Van Laere | |
| 6,561,353 | B2 | | 5/2003 | Levieux et al. | |
| D480,660 | S | | 10/2003 | Faulkner | |
| 6,745,514 | B1 | | 6/2004 | Myrland | |
| 6,782,659 | B2 | | 8/2004 | Van Laere | |
| 2003/0197053 | A1 | | 10/2003 | Haraldsson | |
| 2004/0031842 | A1 | | 2/2004 | Westerman et al. | |

FOREIGN PATENT DOCUMENTS

| | | | |
|---|---|---|---|
| DE | 9011923 | U1 | 10/1990 |
| EP | 1084958 | A1 | 3/2001 |
| GB | 477926 | A | 8/1935 |
| GB | 490316 | A | 8/1938 |
| GB | 714265 | A | 8/1954 |
| GB | 2121383 | A | 12/1983 |
| GB | 2276870 | A | 12/1994 |
| GB | 2415956 | A | 1/2006 |
| WO | 02/076840 | A1 | 10/2002 |

OTHER PUBLICATIONS

International Search Report dated Jul. 8, 2010. PCT/US2009/64420.
Copending U.S. Appl. No. 29/350,841, filed Nov. 24, 2009.
Copending U.S. Appl. No. 29/344,203, filed Sep. 25, 2009.

* cited by examiner

FOLDABLE PACKAGING CONTAINER

CLAIM OF PRIORITY

The present application is a continuation-in-part and claims the benefit of the filing date of U.S. application Ser. No. 12/566,766 (filed Sep. 25, 2009), the entirety of the contents of that application being hereby expressly incorporated by reference.

FIELD OF THE INVENTION

The present invention relates generally to foldable packaging, and more specifically to liquid-resistant paperboard form that is foldable to provide an attractive stackable container that resists water leakage, can be assembled without fastening hardware and has a concealed gusset structure.

BACKGROUND OF THE INVENTION

Paper based packaging materials are frequently utilized for containing and/or transporting a wide range of consumer goods. The paper based nature of these packaging materials results in products that are relatively lightweight, inexpensive, reasonably sturdy and can be easily disposed of and/or recycled. Many of these packaging materials are produced in a flat format and can be folded to create a container. However, there are a number of disadvantages to foldable paper packaging. Any paper material that is pliable enough for easy folding is usually not strong enough to withstand substantial weight or pressure. Further, many paper packaging products are incapable of containing liquids given the risk of degradation to the paper material upon extended liquid contact or the risks associated with paper's propensity for tearing. Paper packaging also tends to be imprecise in adjusting to fit a range of product sizes such that additional packing materials and/or lids are required to ensure that a product is maintained within the packaging.

To facilitate folding, many foldable paper packages will employ gussets to help define corners. Historically, the approach has been to locate all of the gussets on an external part of the package. In some instances such external gusset structures have the potential to detract from the aesthetic appeal of the container. They also provide a structure that has a relatively large potential to snag against an object when moved and cause disassembly to occur. Having all gussets as external gussets further has the potential to attract and accumulate externally visible dust or other matter when stored over extended periods.

Like external gussets, external locking tabs also have the potential to detract from the usefulness of a packaging that incorporates them. Such locking tabs usually have a bulbous portion that forms an interfering fit with an opposing wall via a slot in the wall. The bulbous portion often projects hook-like from a neck portion that tends to be weak under stress and may be easily torn. External structural features such as on all external gusset structures and locking tabs further make printing or imparting any graphic design to the external surface difficult.

It is also common that paper based packaging products are shaped in a way that renders them un-stackable in folded format. Further, many paper based containers include an integrated lid for maintaining contents within the container.

U.S. Pat. No. 5,853,121 discloses a foldable packaging product purporting to have a leak proof corner construction to act as a temporary cooler for carrying food products. The paperboard cooler includes externally visible locking tabs and no mechanism for maintaining a product securely within the cooler, other than an integrated lid portion. Further, as the drawings depict, the corner gussets are folded on the exterior of the cooler to prevent food and other contents from slipping between folds and possibly contaminating the cooler.

U.S. Pat. No. 4,119,265 discloses a foldable packaging purporting to be leak-proof. However, the packaging includes gussets that are folded along the exterior surface of the packaging (as shown in the drawings) and an integrated attached closure structure. Further, the box contains no mechanism for maintaining any items within the packaging, other than a standard integrated lid. The packaging is intended for food shipment.

Paper based foldable packaging solutions may be designed to house one or more specific articles of a known size. This may be acceptable for applications in which the contents are of a standardized size and/or geometry. However, for containing some items, use of these is impractical, due to wide variations in content configuration. For example, in the packaging and sale of horticulture products, such as potted plants, floral arrangements or other bouquet arrangements, additional considerations are raised. First, the arrangements tend to be carried in a pot which may often be an unadorned or mundane shaped plastic container. Such containers come from a wide range of sources and the industry is not standardized. As a result, pots are manufactured in an untold number of varying heights, diameters, or other sizes.

Accordingly, in view of the above, there exists a need for product packaging which overcomes some or all of the above drawbacks in the art. For example, there is a need for a packaging that includes an attractive exterior surface which may contain no externally visible folds, tabs, or other structural features. There is also a need for a product packaging that can contain an article without an integrally attached lid. There is a further need for packaging that can maintain contact with liquids for extended periods of time without material degradation or leaking.

SUMMARY OF THE INVENTION

The present invention meets some or all of the above needs by providing a packaging that includes a base portion; a plurality of side walls each having (i) a first end that is connected to the base portion (ii) a second end and (iii) at least two laterally spaced apart side edges; at least one inwardly folded gusset attached to and disposed between adjoining side walls along respective side edges of the side walls; at least one inwardly folded free end flap portion that extends from each side wall that is folded inwardly and extends over a portion of such side wall and defines a folded edge for the packaging that is distal from the base portion, and which at least one article retention structure integrally formed in the packaging for securing a position of at least one article within the interior of the packaging, wherein the article retention structure is concealed from exterior side viewing.

Advantageously, the packaging may be formed (e.g., die-cut, scored and/or pre-broken) from a single sheet form (e.g., a coated paperboard form) having a liquid resistant material defining at least a portion of at least one inwardly facing surface. Among the various features that the packaging may exhibit that can contribute to its advantages are that at least one inwardly folded free end flap portion may include at least one securing structure integrally formed in the packaging for securing the folded free end flap portion in a folded condition. For example, the securing structure may include at least one wing that projects laterally from at least one inwardly folded free end flap portion and operates to achieve an interference engagement (e.g., at least one wing may have at least one generally straight edge, that operates to achieve an interference engagement by a bearing relationship between a surface and the at least one generally straight edge).

Not only does the above provide a structure that can conceal the gussets from exterior side viewing, but also each securing structure and article retention structure is concealed from exterior side viewing.

By way of a specific example, without limitation, the teachings herein will illustrate a liquid resistant packaging comprising: a base portion; a plurality of tapered side walls each having (i) a first end that is connected to the base portion (ii) a second end and (iii) at least two laterally spaced apart side edges, at least one inwardly folded gusset attached to and disposed between adjoining side walls along respective side edges of the side walls; at least one inwardly folded free end flap portion that extends from each side wall that is folded inwardly and extends over a portion of such side wall and extending downward along the interior of the side wall and defining a folded edge for the packaging that is distal from the base portion, and at least one securing structure integrally formed in the packaging for securing at least one of folded free end flap portions in a folded condition, at least one article retention structure integrally formed in the at least one free end flap portion for securing a position of at least article within the interior of the packaging, wherein the packaging is formed from a single sheet form having a liquid resistant material defining at least a portion of at least one inwardly facing surface, and further wherein one or both of the securing structure or the article retention structure is concealed from exterior side viewing.

Also contemplated within the scope of the teachings herein are generally planar sheet forms that are shaped and scored so that the form folds upon itself to form a packaging as described herein. The process of making the forms and the packaging are also within the present teachings. A variety of uses are made possible by the teachings herein including but not limited to using packaging to contain one or any combination of a potted plant, a bouquet, a gift or gift assortment, promotional materials, wedding favors, party favors, other large event favors, or handouts.

The packaging herein offers any of a number of benefits and advantages, including but not limited to one or any combination of the following: the top of the packaging may remain open for both expanded contents space and display purposes; the top edge that is distal from the base portion may be a folded/finished edge; all gussets and locking wings may be folded into the interior of the packaging so that they are concealed from view; the packaging may include interior (externally concealed) retaining means with adjustability for shape and size of the packaging contents; the packaging therefore may also include a smooth continuous outer surface thereby simplifying the addition of decorative elements to the exterior of the packaging; the packagings may be stackable so that they are able to be nestingly placed within other packagings; the packaging may include precise corners that resist crushing and bowing; the packaging may be liquid resistant so that water can be placed within the packaging without risk of leaking or material degradation; and the packaging may be assembled in a manufacturing operation requiring a relatively small footprint in as much as conveyers are unnecessary for product handling.

DETAILED DESCRIPTION

Figure 1:
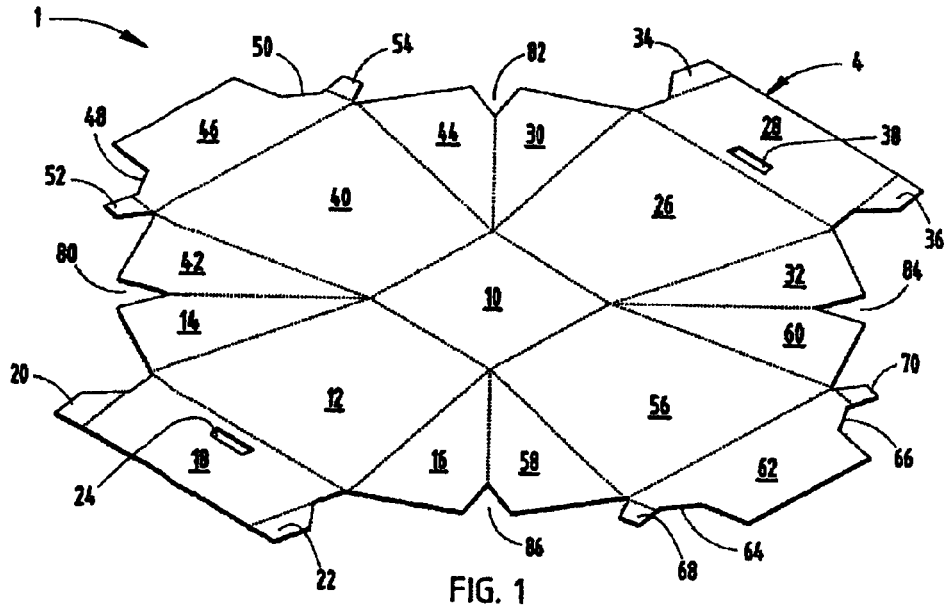
FIG. 1 is a perspective view of a die cut pattern for forming a packaging of the present invention.
Figure 2:
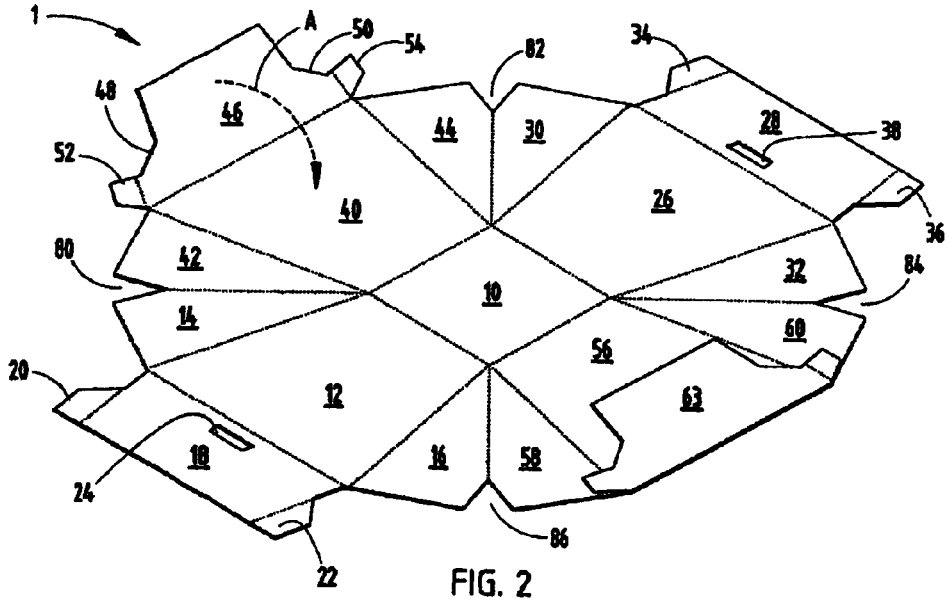
FIG. 2 is an illustration of the packaging shown during a first step of assembly.

In general, the invention described herein provides for a packaging that includes a base portion and a plurality of side walls. The plurality of side walls may each have (i) a first end that is connected to the base portion (ii) a second end and (iii) at least two laterally spaced apart side edges. The plurality of side walls may each further include at least one inwardly folded gusset attached to and disposed between adjoining side walls along respective side edges of the side walls. One or more of the plurality of sidewalls may also have at least one inwardly folded free end flap portion that extends from each side wall and is folded inwardly and extends over a portion of such side wall and defines a folded edge for the packaging that is distal from the base portion. The free end flap may extend downward along the interior side wall so that it covers only a portion of the interior side wall. The packaging described herein may include at least one article retention structure integrally formed in the packaging for securing a position of at least one article within the interior of the packaging. The article retention structure may thus be concealed from exterior side viewing.

The present invention further provides for a packaging that is processed to provide a container capable of maintaining liquid within the confines of the container for items requiring water or moisture contact. The packaging may be made from a sheet form (e.g., a paperboard form) that initially is provided in a flat format that will typically include preselected scoring for precise fold lines so that the packaging may be easily and precisely machine-folded or hand-folded to define a finished container that is attractive, durable, and capable of holding an amount of liquid without leakage for an extended period of time (e.g., 1 day, 1 week, 1 month, 3 months, or longer). The packaging may include a layer of material that imparts a liquid (e.g., water) resistance characteristic to the packaging.

The packaging may be formed in a standard shape, but produced in a number of varying sizes. The packaging may further include one or a plurality of article retention structures so that it may contain any of a wide range of product sizes within it. For example, it can contain pots for horticultural, bouquet, or other arrangements across a range of sizes. It is also possible that the resulting packaging is capable of securely fitting and locking in place a specific size range of products without the need for additional packing materials or coverings.

Prior to folding, the packaging may be a flat sheet material (e.g., a paperboard form) that is die cut and scored to obtain the necessary shape and to impart scored fold lines. In its folded format, the packaging may include an exterior surface, an interior surface, a base portion and a plurality of side walls. The base portion of the packaging may include at least four edges connecting to at least four side walls. The plurality of side walls may be tapered such that the width of each side wall expands as each side wall extends away from the base portion. The tapered format of the side walls can allow the packaging to contain items that also include a tapered structure. As an example, the tapered shape can allow for the packaging to contain items that are generally cylindrical or frustoconical in shape. For example, the packaging may be configured to hold a conventional pot used in horticultural applications such as potted plants.

The packaging may include corner areas or gussets that are specifically configured to allow the packaging to be folded from a sheet of material into an upright packaging including at least one base portion and one or more side walls. Upon folding, the gussets may be folded so that they are contained within the interior of the packaging so that the exterior of the packaging is substantially smooth and includes no visible indication of folding. The gussets thus, may be concealed. Upon folding the gussets may fold into the packaging so that the side walls are arranged orthogonally to adjacent side walls. The gussets may be die cut to include notches (e.g., v-shaped slots) to minimize or substantially prevent overlap of the gussets at the interior of the packaging during folding, while still allowing the base material to lie in a substantially planar position prior to folding.

For further facilitating the folding process, one or more wings may be attached to one or more inwardly folded free end flaps for providing an interference fit within the interior of the container. A portion of the inwardly folded free flaps may contact a portion of one or more additional free flaps when folded. The inwardly folded free flaps may include a connected edge (connected to the side wall), a terminal edge and one or more side edges. Upon folding the flaps inward, the terminal edge may extend downward along the interior of the packaging so that it contacts or nearly contacts the interior of the base portion. The terminal edge may extend less than 80% of the height of the side wall. The terminal edge may extend less than 50% of the height of the side wall. The terminal edge may extend less than 20% of the height of the side wall. In the event that the packaging is filled with liquid, it may desirable that the terminal edge extend only to a point along the interior side wall so that it does not contact the liquid. At any point in the folding process, an adhesive may be placed between two surfaces that contact one another in the folded format of the packaging. The adhesive may include a pressure sensitive glue that is not water-soluble.

As an additional benefit of the foldable nature of the packaging disclosed herein, the packaging may be free of additional hardware for maintaining the packaging in a folded format. The packaging may be free of fasteners, closures, hooks, handles, clips, eyelets, or any other hardware. The packaging may or may not include a covering (e.g., a lid). It may be free of any integrated attached closure structure. The packaging may or may not include handles or gripping features.

Figure 14:
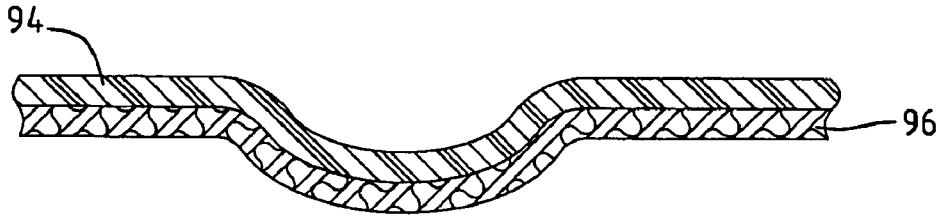
FIG. 14 is a cross-sectional view of a scored fold line depicting scoring of both a paperboard layer and a polymeric layer.

The folding process may be guided by score lines imparted into the packaging to facilitate precise folding of the packaging. The scoring may be deep enough so that the likelihood of imprecise fold lines (e.g., fold lines that waver from or extend beyond the score lines) is reduced as compared with structures that do not employ such lines. Further, the scoring depth is also sufficiently deep to avoid folds having too small of scoring depth which may result in crushed corners due to imprecise folds. The scoring depth may also be sufficiently shallow so that upon folding, any coating (e.g., a water resistant layer) on the form remains intact and does not rupture to expose underlying paperboard. In addition, if the scoring is too deep, the base substrate, any water resistant coating, or both may rupture (during scoring or from stress applied during assembly) which may result in leaking or the inability to maintain an item within the packaging. By way of example, FIG. 14 depicts a cross-sectional magnified view of a score line such that neither the water resistant layer 94 or the paperboard layer 96 are subject to rupture.

The packaging may also include a portion not intended for holding liquids, such that the packaging includes an area above which the interior material may not be treated for liquid resistance. More specifically, as described above in regard to the end flaps being folded over the folded edge to contact the interior of the side wall, the exterior of the end flaps (which post-folding may be located on the interior of the packaging) may not be treated for water resistance. Therefore, any liquid within the packaging may extend only up to the terminal edge of any end flap. Thus, the terminating edge of the end flap creates a fill line above which portions of the packaging may not be treated for liquid resistance. In areas above the fill line, the scoring may be deep enough to actually break through or perforate the base material. The scoring at such locations may be substantially variable so that areas where the base substrate has actually been fractured are contacted with areas that remain connected to prevent breakdown of the packaging. For a paperboard sheet form having a thickness of from about 14 point to about 22 point, the scoring depth for at least a portion of the score lines (e.g., any score lines located below the fill line) may be greater than about 0.5 point. The scoring depth for at least a portion of the score lines may be less than about 4 point. The scoring depth for at least a portion of the score lines may be about 2 point. Any perforated portion of a score line may have a scoring depth sufficient to rupture the base substrate, the polymeric coating, or both. Any portion of a score line adjacent to a perforated portion of a score line may have a scoring depth of greater than about 0.5 point. Any portion of a score line adjacent to a perforated portion of a score line may have a scoring depth of less than about 8 point.

Figure 13:
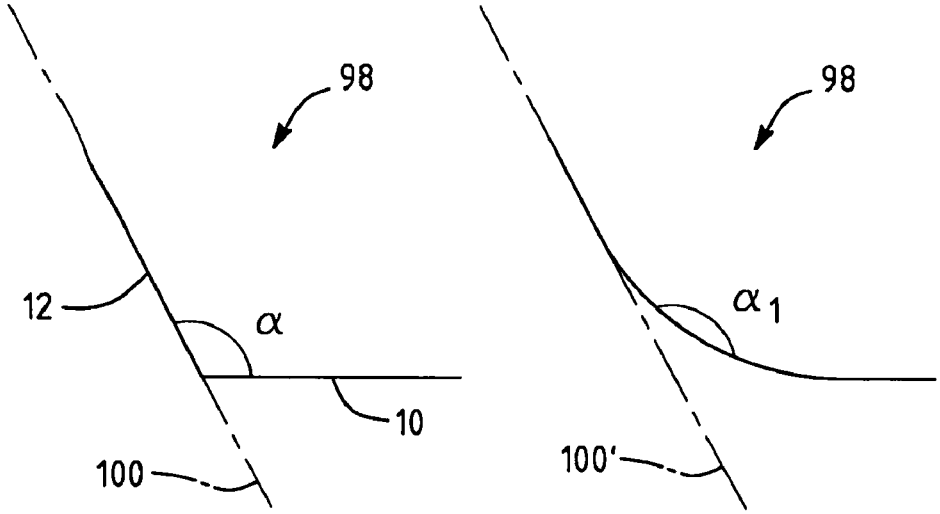
FIG. 13 is a comparative view of a precise corner illustrative of the packaging disclosed herein and a crushed corner.

The scoring and folding process may also result in a packaging displaying precise corner structures. By way of example, in FIG. 13 the corners of the packaging may have a desired angle, $\alpha$. Corners that are less precise as a result of crushing and/or imprecise scoring/folding lines may have an angle of $\alpha_1$ which is at least 20°, at least 30°, at least 40°, at least 50° or more greater than the value of $\alpha$. Further, any tangent 100 drawn to the intersection of the base portion 10 with a side wall 12 may be nearly or substantially co-extensive with the side wall. As depicted in the example of the crushed corner, the tangent $100_1$ may deviate from the angle and direction of the side wall.

Upon folding along the score lines, the interior of the packaging may include an article retention structure that secures items within the packaging. This article retention structure thus allows items to be maintained within the packaging without need for a lid (e.g., an integrally attached lid) or additional packing material. The article retention structure may be included in a variety of locations so that items over a wide range of sizes may be securely placed into a standard packaging. As an example, the packaging may be manufactured in a finite number of incrementally increasing standard sizes (e.g., three, four, five, or more standard sizes) that are adapted to receive a larger number of different articles (e.g., more than four different sized pots, in the case of horticulture products). Each of these standard sizes may contain a number of article retention structures so that each standard packaging is capable of securely locking items having a range of sizes.

As a specific example, for packaging designed to hold a potted plant, there is no standardization of pot sizes. Thus, a pot can be any size having nearly any circumference and diameter. In an effort to create standardized packaging that will lock a plant pot of any size into place, the packaging may include multiple article retention structures at varying heights along the interior of the packaging so that each standard size of packaging can securely fasten a range of pot sizes into place. Further, as shown for example in FIGS. 9C and 9D, the free end flaps may exhibit an ability to flex closer to and further from the side walls so that the size range of pots that may be retained by the retention structure is broadened.

The article retention structure generally will include a surface that is spaced from the base portion of the packaging (e.g., above the base portion) and will have a surface (e.g., an edge, a flange, or otherwise) that urges an article toward the base once inserted. By way of example, the article retention structure may be formed from one or more slots placed along the interior of the packaging. The slots may be cut-outs formed into the base substrate such that the top edge of a cut-out will contact an edge of item so that the item is securely maintained within the packaging with no need for a lid or additional packing material.

The slots may be placed on the interior of at least one side wall of the packaging. More specifically, the slots may be located on the free end flap so that upon folding inward, the slot is located on the interior of the packaging. The slots may be placed on at least two end flaps of the packaging. The slots may be placed on every end flap of the packaging. In the event that multiple slots are placed on one or more end flaps, the slots may be arranged so that they are substantially parallel to one another at varying heights so that any item placed within the packaging will come into contact with one or more slots located at a height near to or equal to an edge height of the item where it contacts the interior of the packaging. The slots may further be arranged for contacting an additional attachment for use in conjunction with the packaging. As an example, the slots may engage a handle or hook structure for carrying, hanging, or displaying the packaging and its contents. The slots may also be adapted to receive or otherwise carry an engaged article, such as a whimsical item (e.g., a decorative element such as flags, ribbons, candy, photos or the like).

The base substrate for forming the packaging may be any material pliable enough to be scored and folded but strong enough to withstand the weight of a contained article. A particular feature of the material may be that it is durable enough to hold liquids for an extended period of time without risk of leaking. The substrate may be formed of paper materials including but not limited to paperboard, chipboard, cardboard, fiberboard, natural fibers, mineral fibers or any combination thereof. The material may be a virgin material, a post-consumer recycled material, or both. The substrate material may be a recyclable material and/or a biodegradable material. If the substrate material includes paperboard, the paperboard may be a bleached or unbleached paperboard. For example it may be a solid bleached sulfate (SBS) paperboard. The material may contain a major portion that can be recycled. The base substrate material may be formed of a polymeric material including but not limited to thermoplastics, thermoset plastics, elastomeric containing materials or any combination thereof. Examples of polymeric materials that may be employed include polyamide, polyester, polystyrene, polyethylene (including polyethylene terephthlate, high density polyethylene and low density polyethylene), polypropylene, polyvinyl chloride, bio-based plastics/biopolymers (e.g., poly lactic acid), silicone, acrylonitrile butadiene styrene (ABS), or any combination thereof.

The base substrate material may inherently be a water-resistant material so that no additional treatment is required to impart water resistance. The gauge of the base substrate material may vary depending on the size of the packaging or the desired strength of the packaging. As an example, if the base substrate material includes paperboard, the gauge of the paperboard may be greater than about 14 point paperboard. The gauge of the paperboard may be less than about 22 point paperboard.

Many materials, especially the paper-based materials disclosed above, may degrade upon contact with liquids and/or moisture. This risk may increase with constant liquid or moisture contact over an extended period of time. Thus, the base substrate material may include a layer of a material to improve liquid resistance so that it produces a paper-based packaging capable of extended contact with liquids (e.g., 1 day, 1 week, 1 month, 3 months, or longer), the base substrate material may include a layer of a material to improve liquid resistance. The packaging may include any material that may act as a water barrier or that surface treats the substrate material to impart hydrophobicity to the material.

This layer of material may be a wax material or may be polymeric material, examples of which may include rubber, polyethylene, polyurethane, polyvinyl chloride, silicone, or any combination thereof. The layer may also be biodegradable and may include cellulose, calcium, starch or combinations thereof. This layer may be applied to the interior of the packaging, the exterior of the packaging, or both. The thickness of the layer of material may be greater than about 0.005 mm. The thickness of the layer of material may be less than about 0.3 mm. The thickness of the layer of material may be greater than about 0.0127 mm. The thickness of the layer of material may be less than about 0.0508 mm. The packaging may also include additional coatings to promote the durability of the packaging such as a varnish, aqueous, or ultra violet coating. Any layer or coatings may be applied to the packaging by lamination, co-extrusion, or any coating process such as rolling, brushing, dip coating or spray coating.

The packaging may be assembled at a single location or at different locations. For example, a form may be created at a first site (e.g., a cutting and/or scoring facility) and then provided to a second site (e.g., a folding facility) where it is folded. The packaging may be shipped or otherwise provided in a flat format. The packaging may also be partially folded prior to shipping. The packaging may be substantially completely folded and then shipped. The tapered shape of the side walls in the folded format allows for multiple packagings to be nested within one another during production and/or shipping. If desired, the nesting capability can help avoid the need for conveyors (otherwise needed for moving non-stacking containers during production) means during the manufacturing process. Thus, a relatively small footprint assembly facilities may be used reducing the space, equipment, and/or labor required for forming the packaging. The packaging may be machine folded or folded by hand. The packaging may be partially machine folded and partially folded by hand. The packaging may be partially machine folded, then shipped such that the folding process is completed by hand.

The packaging exhibits a number of qualities and characteristics that allow it to serve well in applications where long distance transport occurs. For example, it is possible that it will be generally liquid resistant and thus also capable to withstand ambient humidity conditions that may occur in transport vehicles, warehouses and/or greenhouses. It may also allow the material to withstand climatic conditions that may change going from one geographic region to another where the distance traveled is more than about 10 km, 100 km, or even 1000 km. Another characteristic is that the packaging is capable of withstanding other harsh conditions typical to shipping and transport such as vibration. The folded packaging may therefore be able to withstand a standardized vibration test for shipping containers (such as that set forth in ASTM test method D-999).

The packaging may also include designs or coverings to add a decorative element to the packaging. The packaging may be covered with a decorative coating that is extruded onto the exterior of the packaging, the interior of the packaging, or both. As an example, the packaging material may be covered in a metallic coating (e.g., a metalized polyethylene and/or polyester coating). The packaging may include a foil covering. The packaging may also include a coating for projecting a holographic-type image or pattern. Any coating or other design element may be attached to any surface of the packaging via an adhesive. Any coating or other design element may be ink jet or laser printed directly onto any surface of the packaging. The design element may include a sleeve that is placed onto the exterior surface of the packaging. Any surface of the packaging may be embossed, printed, silk-screened, or engraved with a design element. Any design element or coating may be customizable. A customized design element may be added to the packaging at a point of manufacture or may be added to the packaging at a point of sale. The customized design element may be added by the consumer. Any coating or design element may include a preloaded adhesive material or other attachment means for simplified placement of the coating or design element onto the packaging.

The design aspect and generally low cost of the packaging described herein makes the packaging useful for mass distribution at large events such as weddings, business conferences, school functions and the like. The present teachings thus also contemplate use of the packaging herein for containing gifts, souvenirs, merchandise, promotional items, or the like.

The packaging may therefore also include a covering such as a lid. A covering or lid may include a number of attributes including one or more apertures for providing the entry of items into the packaging. One or more apertures may be included to facilitate maintaining a decorative aspect in contact with the lid. By way of example, FIG. 10C depicts a lid including an aperture for placing informational cards such as entry forms, data forms or business cards into a packaging. One or more apertures may be provided so that a decorative aspect (e.g., a ribbon, bow, or the like) may be fed through the one or more apertures to maintain the decorative aspect in contact with the lid. The packaging may also contain an internal structure (such as that shown in FIG. 11) such as a platform 91 or holding device for containing an item.

Figure 9A:
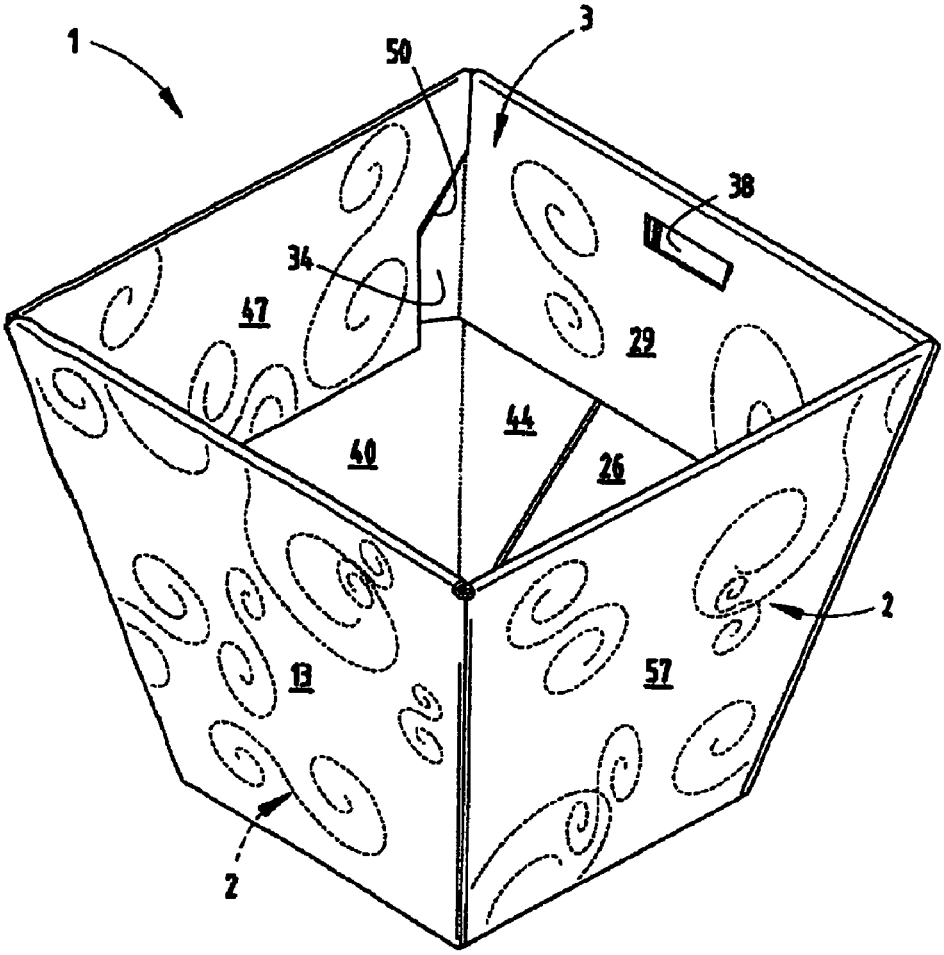
FIG. 9A is a perspective view of an illustrative packaging in accordance with the present teachings.

Referring initially to FIGS. 1 and 9A, there is shown an illustrative example of a packaging 1 embodying the present invention, which is formed from a die cut pattern 4 made of a suitable paperboard material. The material may be a C1S (coated one side) SBS (solid bleached sulfate) about 14 point to about 22 point paperboard laminated with a polyethylene film of from about 0.01 mm to about 0.07 mm thick. The material forming the die cut packaging 1 can be poly-coated on both sides or just one side. The opposite surface of the die cut pattern forming the outer surface of the packaging is printed with decorative indicia 2, which can be any type of design. The printing can have a holiday theme, such as Christmas decorations, photographic scenes, a Valentine's Day theme, and any decorative pattern or style desired. Thus, the use of a die cut pattern for forming the packaging 1 allows one side of the material to be printed with practically any desired indicia 2 including foil, textured foil and the like. The resultant, generally trapezoidal packaging 1, as seen in FIG. 9A, has a relatively large rectangular top opening 3 which allows the easy insertion of a pot therein. By providing the generally trapezoidal sides of the packaging 1, a unique design appearance is provided by the packaging which further enhances its aesthetic appearance.

Referring to FIG. 1, there is shown a die cut pattern or form 4 for a packaging 1 embodying the present teachings. The pattern integrally includes a generally rectangular (e.g., square) base 10, having a first side panel 12 integrally extending therefrom with two gussets 14 and 16. As seen the gussets may resemble two axially symmetric portions such as quadrilateral or generally triangular shaped flap units. An end flap 18 integrally extends from first side panel 12 and includes outwardly extending wings 20 and 22. On the opposite side of base 10 is a second side panel 26 extending from base 10 and integrally including gussets 30 and 32 and an outwardly extending top flap 28. Top flap 28 also includes outwardly extending wings 34 and 36 for locking the packaging in an assembled position as described below. Each of the top flaps 18 and 28 also include a slot 24 and 38, respectively, for securing a pot within the packaging.

Additional side panels 40 and 56 integrally extend from base 10 in a direction generally orthogonal to first and second side panels 12 and 26. Side panel 40 integrally includes gussets 42 and 44 on opposite sides, which adjoin and are integrally coupled to gussets 14 and 30. Side panel 40 includes an outwardly extending end flap 46, which includes laterally extending wings 52 and 54 coupled to the generally rectangular end flap 46 by angled corners 48 and 50. On the opposite side of base 10 is a similar side panel 56 integrally bordered by gussets 58 and 60, which integrally adjoin gussets 16 and 32, respectively. Extending outwardly from side panel 56 is a generally rectangular end flap 62 having outwardly extending wings 68 and 70 with angled corners 64 and 66, respectively. The integral gussets 14, 42; 16, 58; 30, 44; and 32, 60 form a foldable web between the side panels 12, 26 and 40, 56, as seen in the assembly steps illustrated in FIGS. 3-8.

The phantom lines shown in FIGS. 1-8 represent fold lines for the assembly process, which can either be manual or can be machine assembled if desired. The assembly (i.e., folding) process is shown in FIGS. 2-8 in which first the end flaps 46 and 62 are folded over onto side panels 40 and 56, respectively, in the direction of arrow A in FIG. 2. The inner surfaces of end flaps 46 and 62 may, if desired, be adhesively attached to the inside of side panels 40 and 56. Such step may, however, be unnecessary with the interlocking flaps and wings holding the packaging in an assembled state. The outer surfaces of the panels and flaps shown in FIG. 1 are identified in the remaining drawing figures with the same number incremented by a single digit. Thus, for example, in FIG. 2, the outer surface of end flap 62 is identified as 63.

Figure 3:
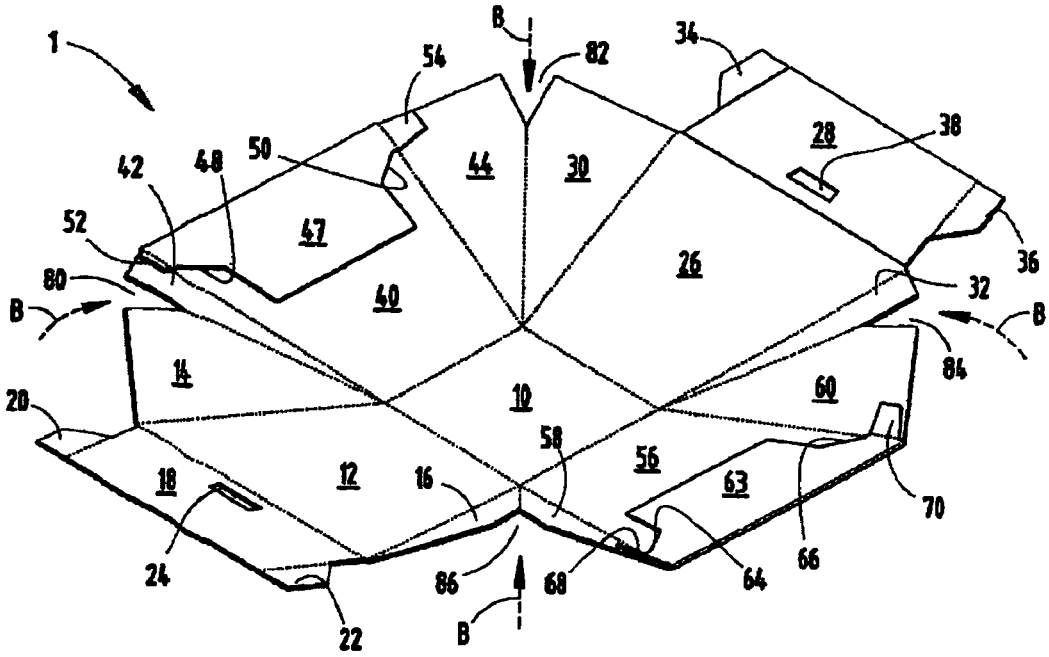
FIG. 3 is a perspective view of the packaging shown in a second step of assembly.

Next, as illustrated in FIG. 3, the adjacent gussets 14, 42, 16, 58, 32, 60, 30, and 44 are deflected inwardly as shown by arrow B in FIG. 3.

Figure 4:
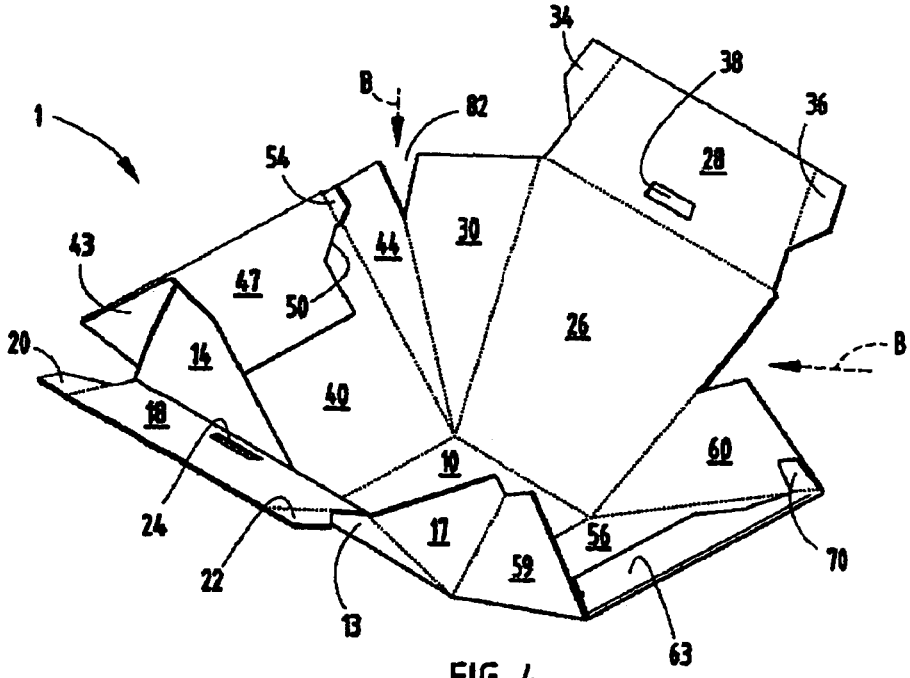
FIG. 4 is a perspective view of a packaging shown in a third step of assembly.
Figure 5:
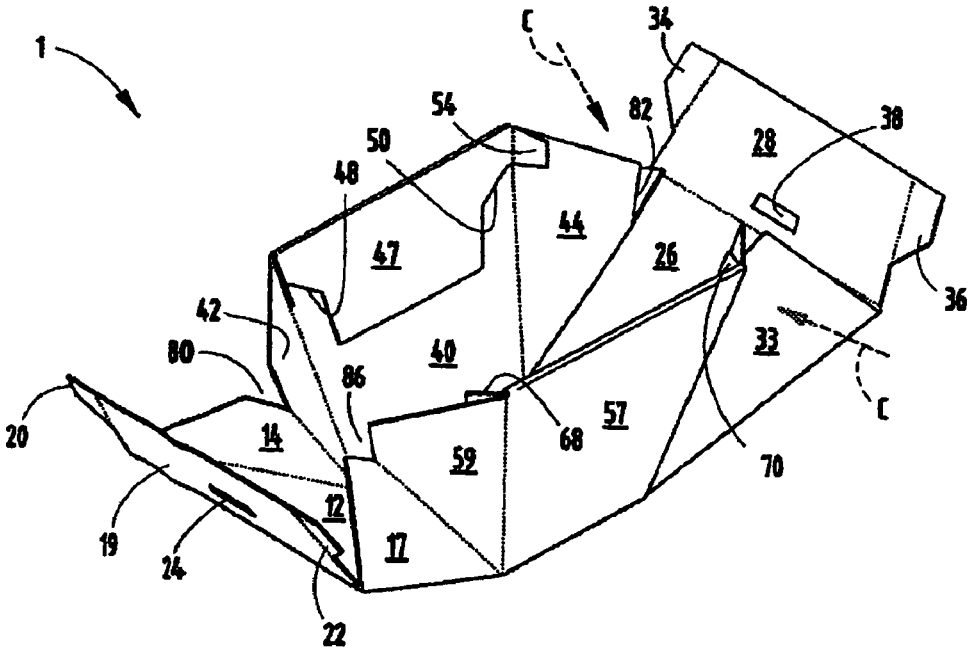
FIG. 5 is a perspective view of a packaging shown in a fourth step of assembly.

This process is continued, as illustrated by arrow B in FIG. 4, until the side panels 40 and 56 are substantially vertical, as shown in FIG. 5. The outer surface 57 of side panel 56 is imprinted with indicia 2, as shown in FIG. 9A, as are the remaining external surfaces of the packaging 1. With the side panels 40 and 56 substantially in the position shown in FIG. 5, the first and second panels 12 and 26 are then folded inwardly, as indicated by arrow D in FIG. 6, such that the extending wings 68, 70, 52, and 54 project inwardly from side panels 40 and 56 and lie adjacent gussets 58, 60; and 42, 44, respectively.

Figure 6:
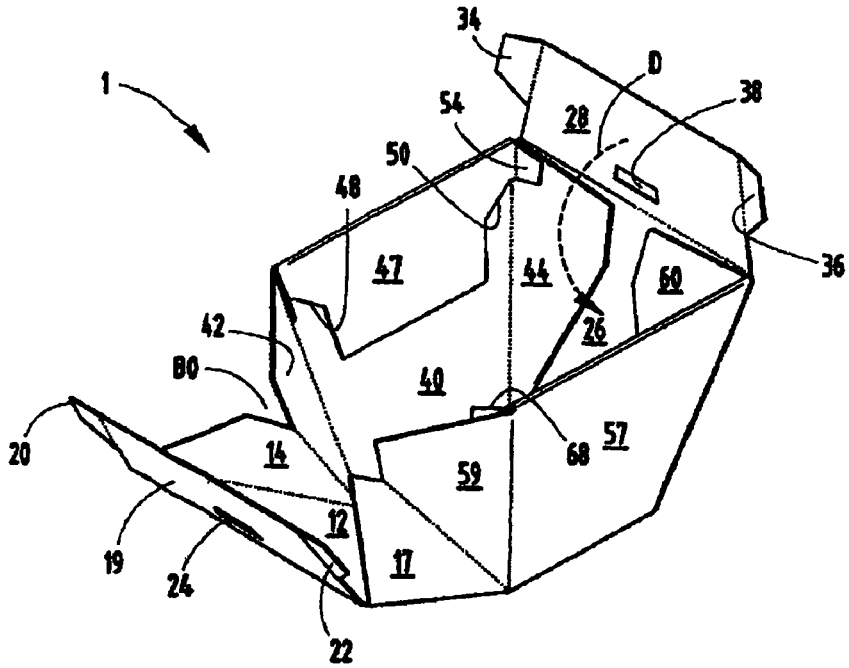
FIG. 6 is a perspective view of a packaging shown in a fifth step of assembly.
Figure 7:
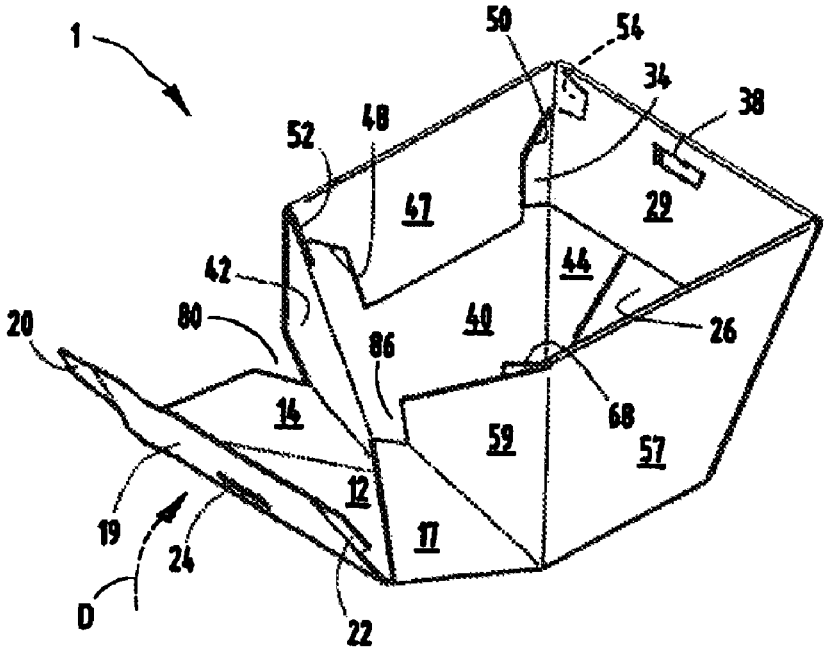
FIG. 7 is a perspective view of a packaging shown in a sixth step of assembly.
Figure 8:
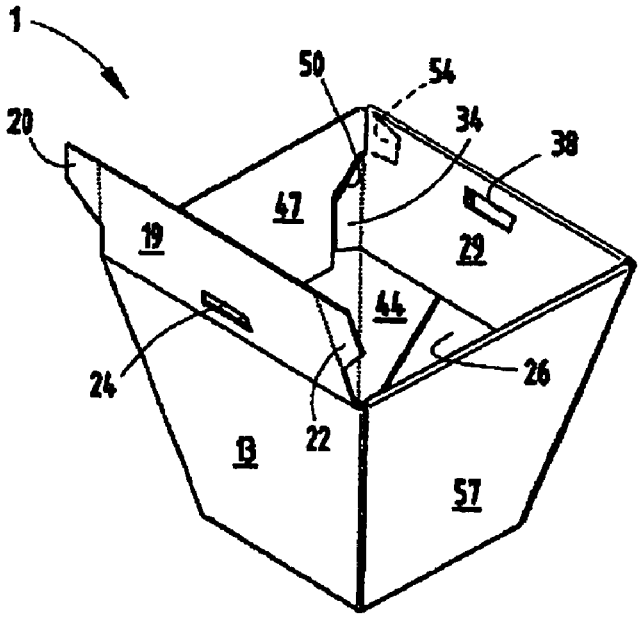
FIG. 8 is a perspective view of a packaging shown in a seventh step of assembly.

Next, the end flaps 18 and 28 are folded over, as shown by arrow D in FIG. 6, and extending wings 34 and 36 and 20 and 22 are tucked over extending wings 52, 54, 68, and 70, respectively, and under end flaps 46 and 62, as seen in FIGS. 7 and 8, to interlock the edges of the packaging to a completely assembled position as shown in FIG. 9A. The outer surface 13 of first side panel 12 likewise is imprinted with indicia 2 as are the remaining outer surfaces, including the outer surfaces 47 of end flap 46, 63 of end flap 62, surface 19 of end flap 18 and surface 29 of flap end 28. Thus, the exposed surfaces of packaging 1 which are visible, including the outer surfaces of the cover itself, and the inner surfaces of the flaps which are exposed when looking downwardly from the top edge of the cover may be decoratively imprinted. The indicia 2 can be printed in any commercially known manner. The slots 24 and 38 in end flaps 18 and 28, respectively, aid in securing a pot within the packaging.

Thus, by providing extending wings 52, 54, 68, and 70 with extending wings 20, 22 and 34, 36 folded over and under end flaps 46 and 62, respectively, the top edges of the packaging interlock. By providing the V-shaped slots 80, 82, 84, and 86 between adjacent gussets 14, 42; 44, 30; 32, 60; and 16, 58, respectively, clearance is provided for the extending wings and gussets to allow the ready assembly of the packaging. Slots 24 and 38 are interior of the packaging and, therefore, are relatively unobtrusive and do not detract from the ornamental appearance of the resultant packaging when assembled as seen in FIG. 9A.

Figure 9B:
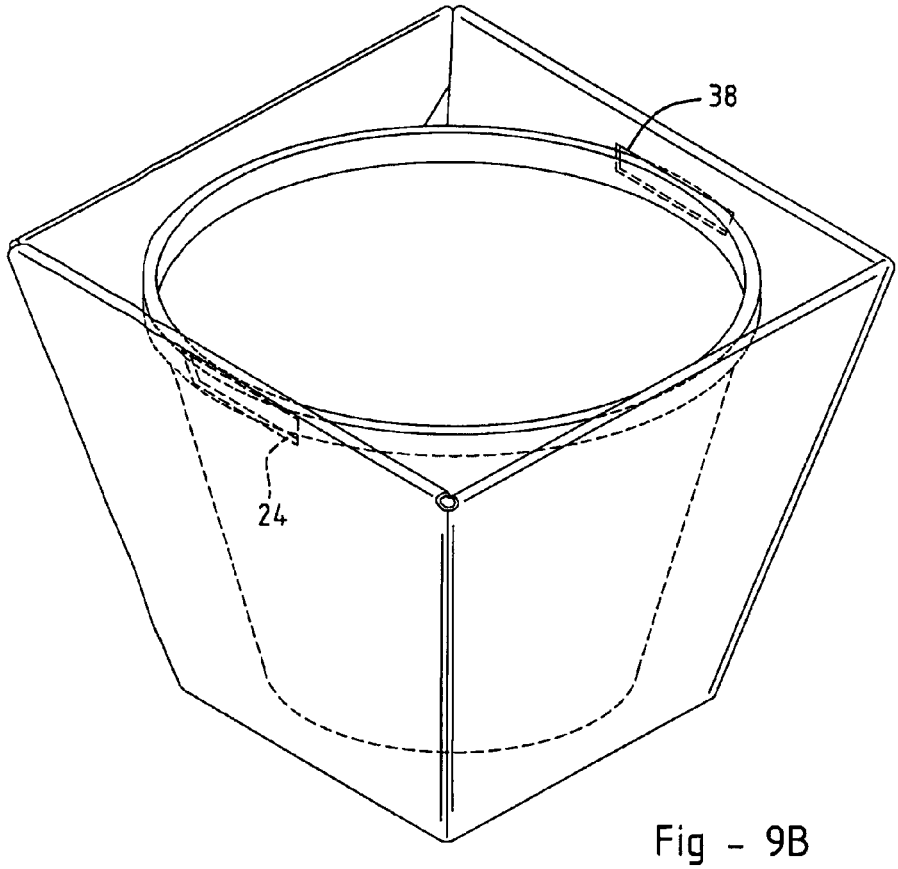
FIG. 9B is a perspective view of an illustrative packaging shown with a plant pot located within the packaging.
Figure 9C:
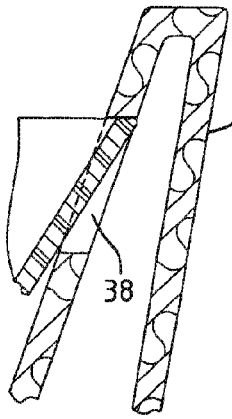
FIGS. 9C and 9D are illustrative cross sectional views of contact between the packaging and an item within the packaging.
Figure 9D:
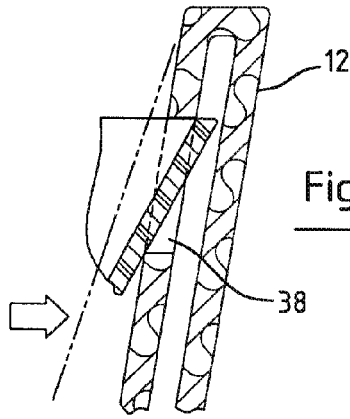

As shown for example in FIG. 9B, the packaging may contain a pot for holding a plant. The slots 24, 38 are shown including a top edge and a bottom edge so that the top edge of each slot contacts the plant pot and holds the pot in place.

Figure 10A:
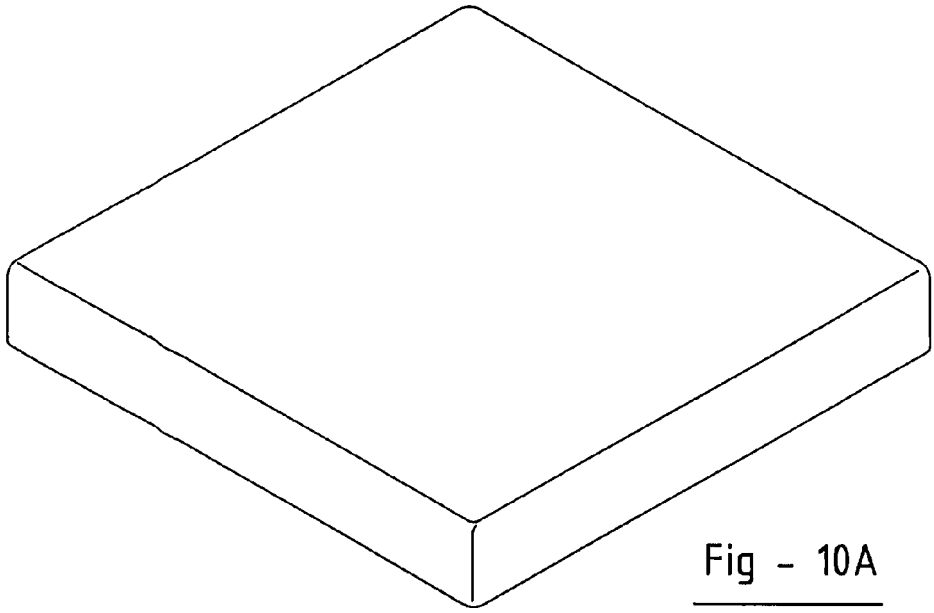
FIG. 10A is a perspective view of an illustrative packaging lid in accordance with the present teachings.
Figure 10B:
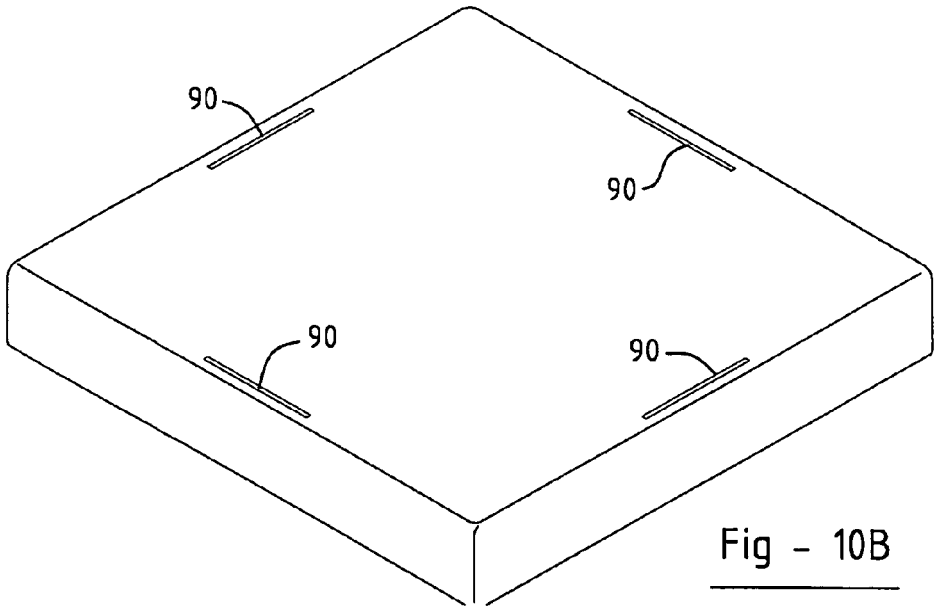
FIGS. 10B and 10C are perspective views of an illustrative packaging lid shown with apertures in accordance with the present teachings.
Figure 10C:
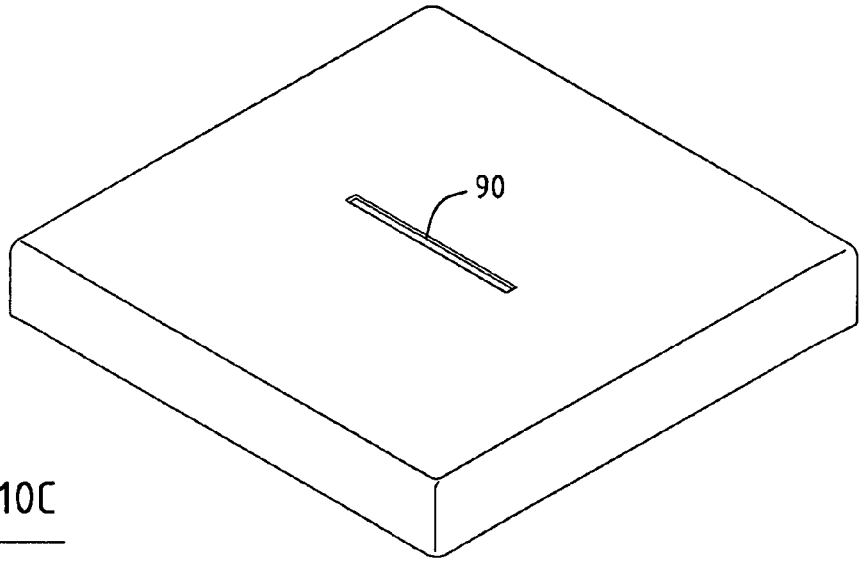
Figure 11:
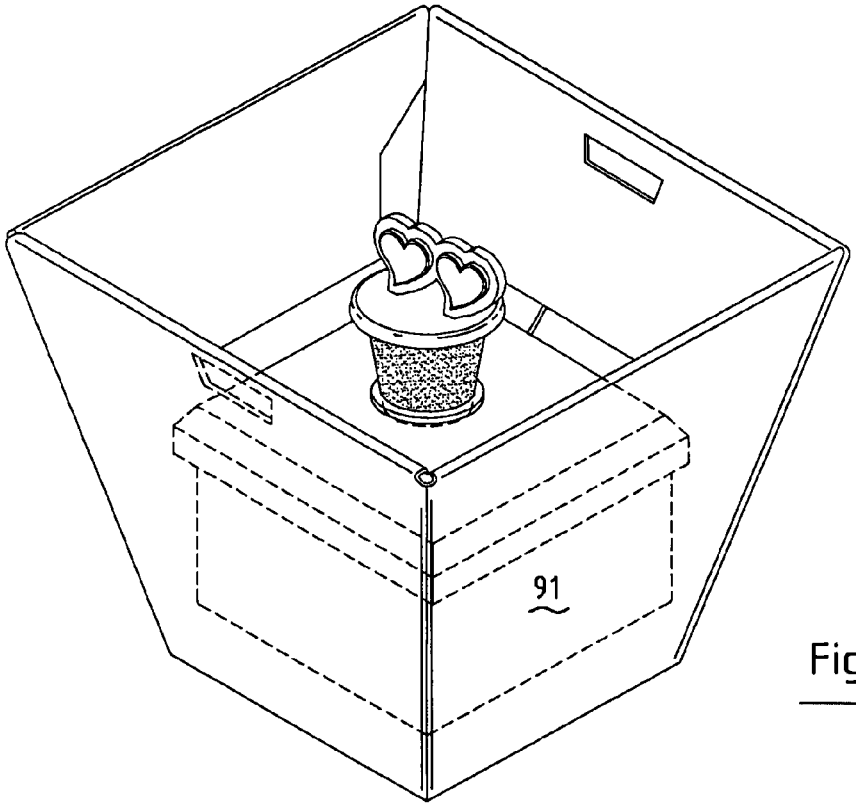
FIG. 11 is a perspective view of an illustrative packaging shown with an internal platform.
Figure 12A:
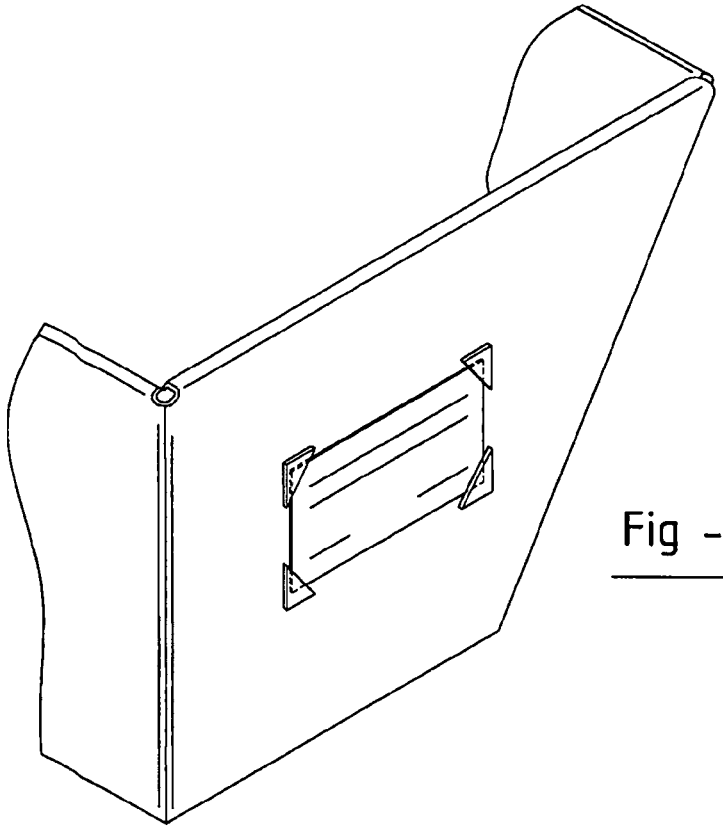
FIGS. 12A and 12B are perspective views of an illustrative packaging and lid shown with attached informational cards.
Figure 12B:
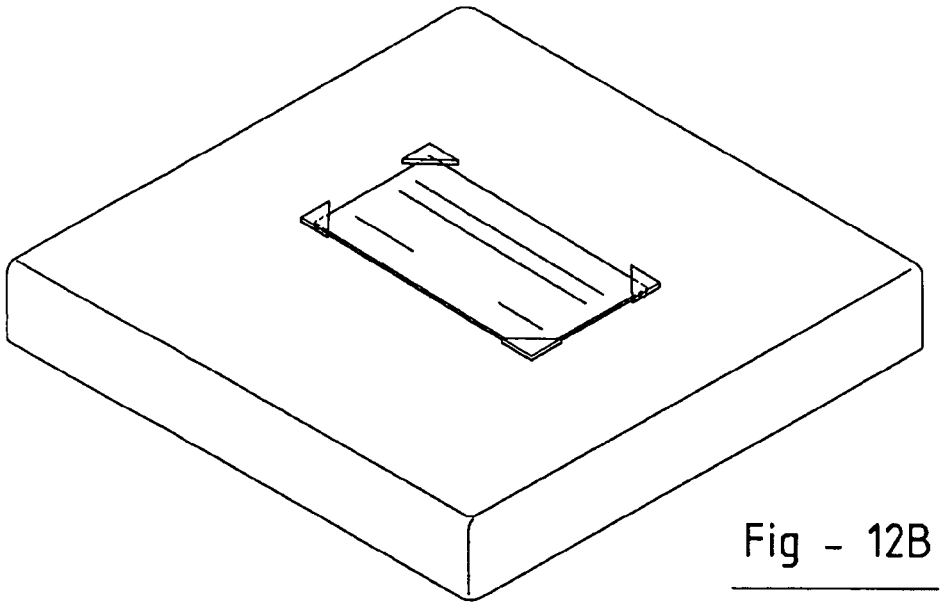

The packaging may also include a lid as illustrated in FIG. 10A. The lid may further include one or more apertures 90, as shown in FIGS. 10B and 10C. The packaging may also include an internal platform 91 for displaying the contents of the packaging as shown in FIG. 11. FIGS. 12A and 12B show an example of how informational material (such as business cards, invitations, promotional material, brochures, or the like) may be attached to the packaging and/or the lid.

The packaging 1 is preferably made to accommodate a variety of sized pots. As an example, for a 15 cm pot, the base 10 may be approximately from about 9 cm to about 12 cm on each side while the side panels may have a height of approximately from about 12 cm to about 15 cm and a width at the top from about 14 cm to about 16 cm. The overlapping and interlocking end flaps 18, 28, 46 and 62 may extend downwardly into the packaging approximately from about 5 cm to about 7 cm.

Though not necessarily drawn to scale, geometries, relative proportions and dimensions shown in the drawings are also part of the teachings herein, even if not explicitly recited. However, unless otherwise stated, nothing shall limit the teachings herein to the geometries, relative proportions and dimensions shown in the drawing.

Unless stated otherwise, dimensions and geometries of the various structures depicted herein are not intended to be restrictive of the invention, and other dimensions or geometries are possible. Plural structural components can be provided by a single integrated structure. Alternatively, a single integrated structure might be divided into separate plural components. In addition, while a feature of the present invention may have been described in the context of only one of the illustrated embodiments, such feature may be combined with one or more other features of other embodiments, for any given application. It will also be appreciated from the above that the fabrication of the unique structures herein and the operation thereof also constitute methods in accordance with the present invention.

The preferred embodiment of the present invention has been disclosed. A person of ordinary skill in the art would realize however, that certain modifications would come within the teachings of this invention. Therefore, the following claims should be studied to determine the true scope and content of the invention.

The explanations and illustrations presented herein are intended to acquaint others skilled in the art with the invention, its principles, and its practical application. Those skilled in the art may adapt and apply the invention in its numerous forms, as may be best suited to the requirements of a particular use. Accordingly, the specific embodiments of the present invention as set forth are not intended as being exhaustive or limiting of the invention. The scope of the invention should, therefore, be determined not with reference to the above description, but should instead be determined with reference to the appended claims, along with the full scope of equivalents to which such claims are entitled. The disclosures of all articles and references, including patent applications and publications, are incorporated by reference for all purposes. Other combinations are also possible as will be gleaned from the following claims, which are also hereby incorporated by reference into this written description.

What is claimed is:

1. A packaging comprising:

a base portion having a liquid resistant material defining at least a portion of at least one inwardly facing surface;

a plurality of side walls each having:

(i) a first end that is connected to the base portion;

(ii) a second end; and (iii) at least two laterally spaced apart side edges;

at least one inwardly folded gusset attached to and disposed between side walls along the side edges of the side walls so that the side walls are adjoined;

at least two of the sidewalls each including at least one inwardly folded free end flap portion that:

(i) extends from the second end of each such side wall;

(ii) is folded inwardly so that it covers a portion of such side wall;

(iii) includes a terminal free edge that is remote from the second end of the side wall and the inwardly folded free end flap extends over a portion of a side wall so that the terminal edge resides generally along the interior of the side wall facing toward the base portion, but spaced apart from the base portion; and (iv) defines a folded edge for the packaging that is distal from the base portion;

(v) includes an article retention structure that is concealed from exterior side viewing, said article retention structure comprises a slot defined in the inwardly folded free end flap portion that has a bottom edge, two side edges, and an upper edge for bearing against packaging contents;

so that at least two of the adjoining sidewalls are generally free of external tabs and gussets and a volume of a liquid can be held in the packaging without contacting the terminal free edge.

2. The packaging of claim 1, wherein the folded edge does not contact any integrated lid structure.

3. The packaging of claim 1, wherein all gussets of the packaging are folded inwardly so that they are generally not visible from external side viewing.

4. The packaging of claim 1, wherein the second ends of each adjoining side wall define an open top having a perimeter and the base portion has a perimeter that is smaller than the perimeter of the open top, and the side walls are tapered and shaped generally as isosceles trapezoids that are located between the rectangular base portion and the inwardly folded free end flap portion.

5. The packaging of claim 1, wherein the at least one inwardly folded free end flap portion includes at least one securing structure including at least one wing having at least one generally straight edge, that projects laterally from the at least one inwardly folded free end flap portion and that operates to achieve an interference engagement by a bearing relationship between a surface and the at least one generally straight edge.

6. The packaging of claim 1, wherein the packaging includes score lines that radiate outwardly from the corners of the base portion and are scored to include an outer portion and an inner portion, and the outer portion folds with less applied force than the inner portion to define a more precise fold.

7. The packaging of claim 6, wherein at least one of the score lines that radiate outwardly from the corners of the rectangle include a perforated portion that extends at least about 10% of the length of such score line and is located at the radial outermost end of the score line.

8. The packaging of claim 6, wherein the entirety of the score lines have a depth that is sufficiently deep to allow folding, but not so deep that prior to or during folding the water resistant material on the packaging will rupture.

9. The packaging of claim 1, wherein the packaging is free of any non-integrated, attached mechanical fastener for securing the packaging in its final folded state.

10. The packaging of claim 1, wherein the packaging includes a foldable tray-type lid.

11. A packaging comprising:

a base portion;

a plurality of side walls each having:

(i) a first end that is connected to the base portion;

(ii) a second end; and (iii) at least two laterally spaced apart side edges;

at least one inwardly folded gusset attached to and disposed between side walls along the side edges of the side walls so that the side walls are adjoined;

at least two of the sidewalls each including at least one inwardly folded free end flap portion that:

(i) extends from the second end of each such side wall;

(ii) is folded inwardly so that it covers a portion of such side wall; and (iii) defines a folded terminal edge for the packaging that is distal from the base portion and does not contact any integrated lid structure, so that at least two adjoining sidewalls are generally free of external tabs and gussets;

at least one article retention structure integrally formed in the at least one inwardly folded free end flap portion for securing a position of at least one article within the interior of the packaging wherein:

(i) the article retention structure is concealed from exterior side viewing; and (ii) the article retention structure includes a slot defined in the free end flap portion that has a bottom edge, two side edges and an upper edge for bearing against packaging contents.

12. The packaging of claim 11, wherein all gussets of the packaging are folded inwardly so that they are generally not visible from external side viewing.

13. The packaging of claim 11, wherein the second ends of each adjoining side wall define an open top having a perimeter and the base portion having a perimeter that is smaller than the perimeter of the open top, and the side walls are tapered and shaped generally as isosceles trapezoids that are located between the base portion and the inwardly folded free end flap portion.

14. The packaging of claim 11, wherein the at least one inwardly folded free end flap portion includes at least one securing structure including at least one wing having at least one generally straight edge, that projects laterally from the at least one inwardly folded free end flap portion and that operates to achieve an interference engagement by a bearing relationship between a surface and the at least one generally straight edge.

15. The packaging of claim 11, wherein the packaging includes score lines that radiate outwardly from the corners of the base portion and are scored to include an outer portion and an inner portion, and the outer portion folds with less applied force than the inner portion to define a more precise fold.

16. The packaging of claim 15, wherein at least one of the score lines that radiate outwardly from the corners of the rectangle include a perforated portion that extends at least about 10% of the length of such score line and is located at the radial outermost end of the score line.

17. The packaging of claim 11, wherein the entirety of the score lines have a depth that is sufficiently deep to allow folding, but not so deep that prior to or during folding the water resistant material on the packaging will rupture.

18. The packaging of claim 11, wherein the packaging is free of any non-integrated, attached mechanical fastener for securing the packaging in its final folded state.

19. A packaging comprising:

a base portion having a liquid resistant material defining at least a portion of at least one inwardly facing surface;

a plurality of side walls each having:

(i) a first end that is connected to the base portion;

(ii) a second end; and (iii) at least two laterally spaced apart side edges;

at least one inwardly folded gusset attached to and disposed between side walls along the side edges of the side walls so that the side walls are adjoined;

at least two of the sidewalls each including at least one inwardly folded free end flap portion that:

(i) extends from the second end of each such side wall;

(ii) is folded inwardly so that it covers a portion of such side wall;

(iii) includes a terminal free edge that is remote from the second end of the side wall and the inwardly folded free end flap portion extends over a portion of a side wall so that the terminal edge resides generally along the interior of the side wall facing toward the base portion, but spaced apart from the base portion so that a volume of a liquid can be held in the packaging without contacting the terminal edge; and (iv) defines a folded edge for the packaging that is distal from the base portion so that the at least two adjoining sidewalls are generally free of external tabs and gussets;

at least one article retention structure integrally formed in the at least one inwardly folded free end flap portion for securing a position of at least one article within the interior of the packaging wherein:

(i) the article retention structure is concealed from exterior side viewing; and (ii) the article retention structure includes a slot defined in the at least one inwardly folded free end flap portion that has a bottom edge, two side edges and an upper edge for bearing against packaging contents.

* * * * *

UNITED STATES PATENT AND TRADEMARK OFFICE

CERTIFICATE OF CORRECTION

PATENT NO. : 7,870,995 B1
APPLICATION NO. : 12/618395
DATED : January 18, 2011
INVENTOR(S) : Dennis M. Kaltman et al.

It is certified that error appears in the above-identified patent and that said Letters Patent is hereby corrected as shown below:

IN THE CLAIMS:

Column 13, Claim 4, Line 25 should read:
--between the base portion and the inwardly folded--

Signed and Sealed this
Eighth Day of March, 2011

David J. Kappos
*Director of the United States Patent and Trademark Office*